United States Patent [19]

McLean

[11] 4,098,067

[45] Jul. 4, 1978

[54] WICK-LUBRICATED SPINNING AND TWISTING RING

[75] Inventor: James N. McLean, Tonawanda, N.Y.

[73] Assignee: Herr Manufacturing Company, Inc., Tonawanda, N.Y.

[21] Appl. No.: 728,925

[22] Filed: Oct. 4, 1976

[51] Int. Cl.[2] ..... D01H 7/62

[52] U.S. Cl. ..... 57/120; 184/7 A

[58] Field of Search ..... 57/119, 120; 184/7 A, 184/81

[56] References Cited

U.S. PATENT DOCUMENTS

| | | | |
|---|---|---|---|
| 2,791,880 | 5/1957 | Raboisson | 57/120 |
| 2,830,433 | 4/1958 | Raboisson | 57/120 |
| 2,936,568 | 5/1960 | Wayson et al. | 57/120 |
| 3,338,045 | 8/1967 | Kaiser | 57/120 |
| 3,831,367 | 8/1974 | Atwood et al. | 57/120 |
| 3,872,662 | 3/1975 | Atwood et al. | 57/120 |
| 3,964,576 | 6/1976 | Atwood et al. | 57/120 X |

*Primary Examiner*—John Petrakes

*Attorney, Agent, or Firm*—Joseph P. Gastel

[57] ABSTRACT

A spinning and twisting ring including a continuous wick confined within an annular conduit in the ring and extending through a bore in the holder and thence through an anchoring fitting between the holder and a lubricant block and terminating in a well in the block to conduct lubricant to predetermined openings in the ring.

13 Claims, 13 Drawing Figures

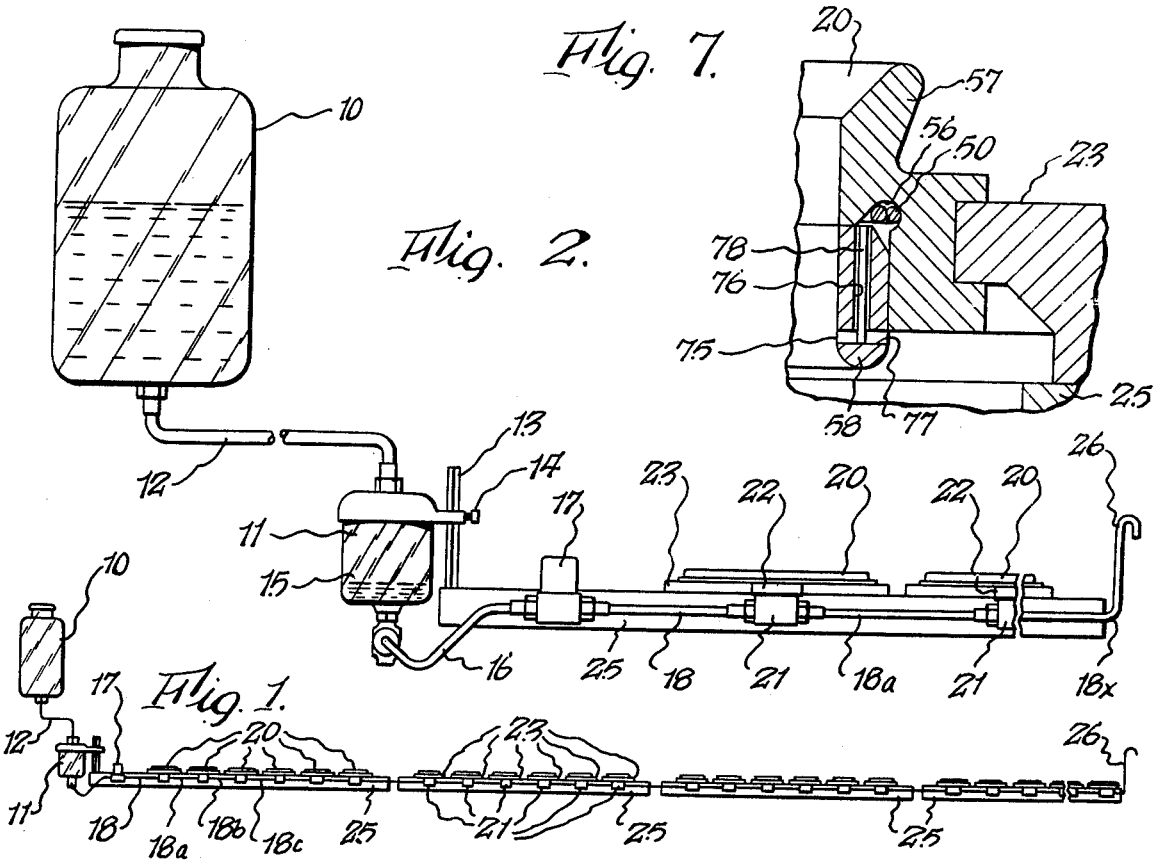
Fig. 7.
Fig. 2.
Fig. 1.
10
11
12
13
14
15
16
17
18
18a
18b
18c
18x
20
21
22
23
24
25
26
57
56
50
78
76
75
58
77
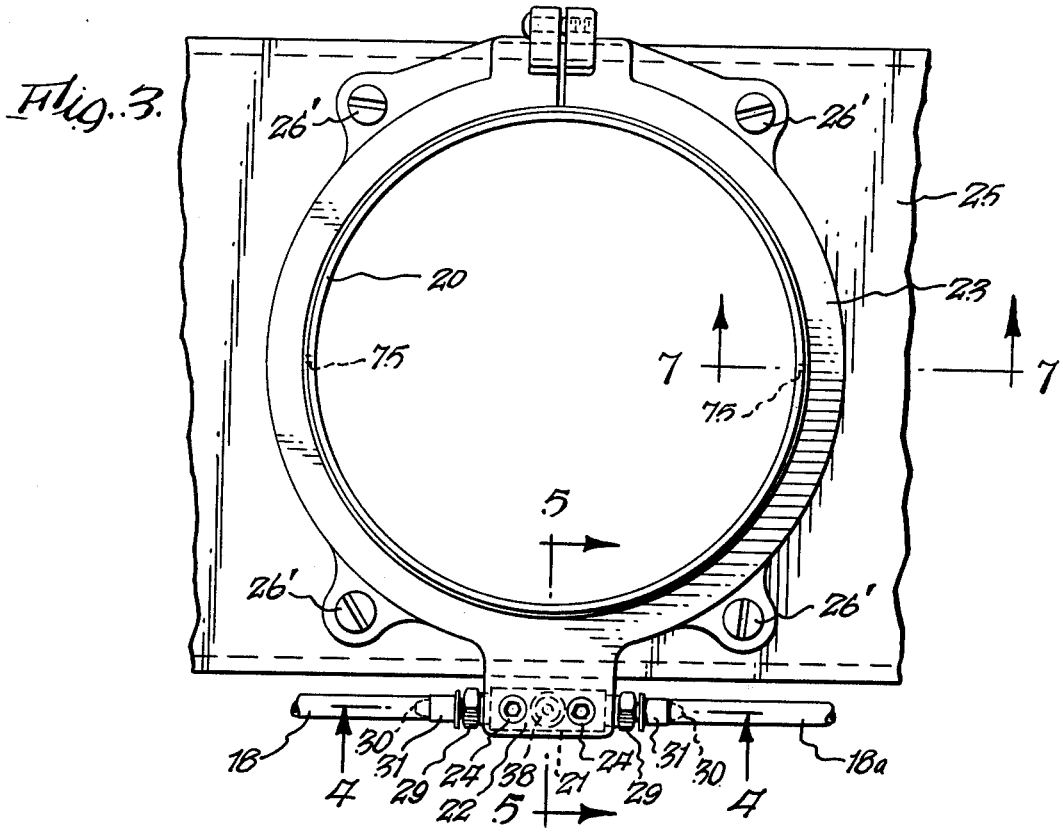
Fig. 3.
26'
25
20
23
75
7
76
5
18
30
31
29
24
38
21
22
18a
4

WICK-LUBRICATED SPINNING AND TWISTING RING

The present invention relates to an improved wick lubricated spinning and twisting ring construction.

By way of background, spinning and twisting rings require precise amounts of lubrication for proper operation. If they receive too much lubricant, the lubricant will drip from the rings. If too little lubricant is supplied, the rings will run dry. In order to supply the correct amounts of lubricant, various systems have been devised. Many of these systems employed wicks. However, in certain prior ring constructions the wick structures were relatively imprecise so that there was insufficient control of lubricant flow for optimum operation. This imprecision was due in part to the fact that the wicks were made up of separate wick portions placed in series. Furthermore, there was no way of stopping the flow of lubricant after the spinning equipment was stopped, and this resulted in the dripping of lubricant onto the floor, with its attendant hazards. Prior types of wick-lubricated rings are exemplified by U.S. Pat. Nos. 2,871,651 and 2,282,468 and British Pat. No. 1,082,798. It is with overcoming the foregoing deficiencies of prior art wick-lubricated ring constructions that the present invention is concerned.

It is accordingly one object of the present invention to provide an improved wick-lubricated spinning and twisting ring assembly having a continuous wick extending from a reservoir and located within an annular conduit within a spinning ring to provide uniform relatively predictable amounts of lubrication without leakage.

Another object of the present invention is to provide an improved wick-lubricated spinning and twisting ring construction which will provide precise lubrication during operation, but which will automatically cease lubricating when the ring is not in operation.

The present invention relates to a spinning and twisting ring construction comprising a holder, a ring mounted on said holder, annular conduit means within said ring, first opening means in said ring in communication with said annular conduit means for conducting lubricant to the outside of said ring for providing lubrication for a traveler, second opening means in said ring for conducting lubricant to said annular conduit means from an external source, said ring being fabricated from first and second ring sections secured to each other in fluid-tight relationship, continuous wick means having a first portion extending substantially throughout said annular groove and a second portion extending outwardly of said ring through said second opening means, and means for supplying lubricant to said second portion of said continuous wick means.

The various aspects of the present invention will be more fully understood when the following portions of the specification are read in conjunction with the accompanying drawings wherein:

FIG. 1 is a fragmentary side elevational view of a spinning ring installation including the improved ring construction mounted on a plurality of rails mounted on a frame;

FIG. 2 is an enlarged fragmentary side elevational view of a portion of FIG. 1;

FIG. 3 is a fragmentary plan view showing a ring on a holder mounted on a rail;

FIG. 7 is a fragmentary cross sectional view taken substantially along line 7—7 of FIG. 3 and showing the construction for conducting lubricant to the lower portion of the ring;

Figure 9:
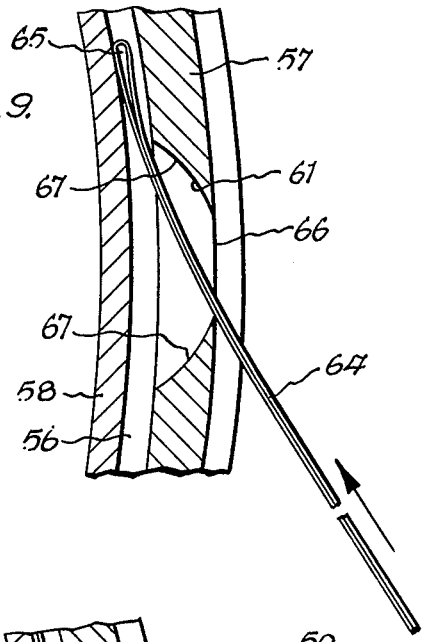
FIG. 9 is a fragmentary enlarged view of the circled portion of FIG. 8, which is designated with the notation "FIG. 9" and showing the threading of a flexible wire into the lubricant conduit.
Figure 10:
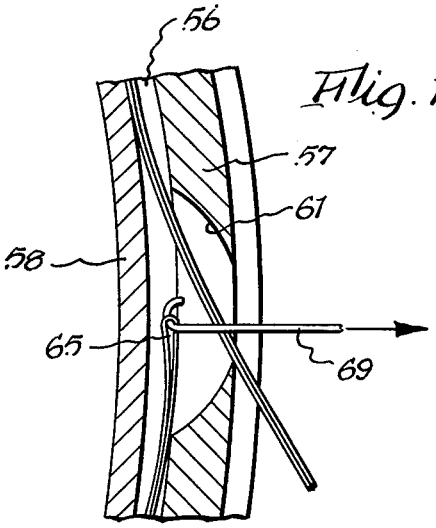
Figure 11:
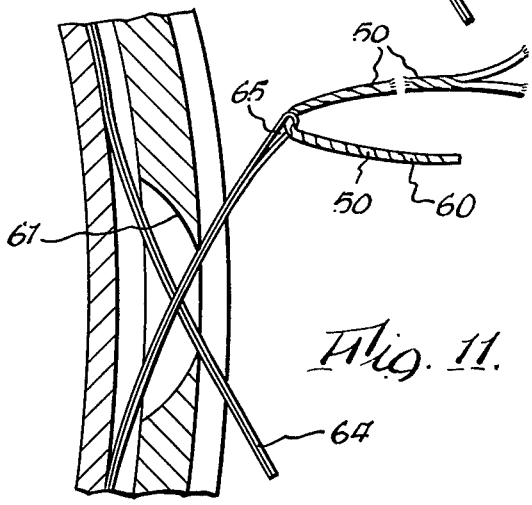
Figure 12:
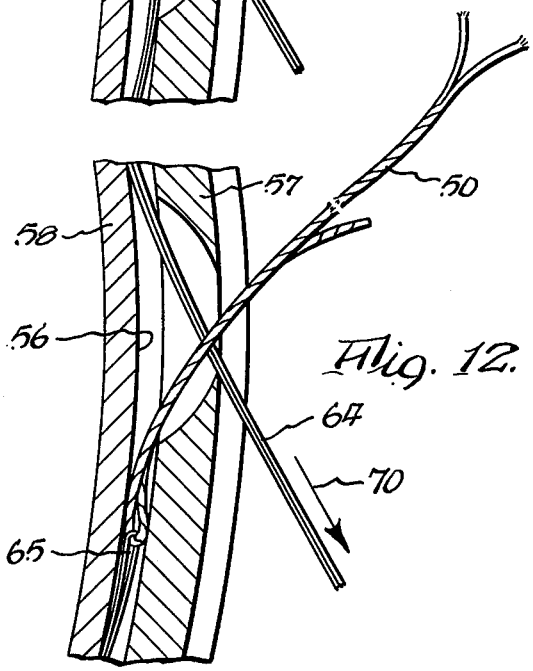
Figure 13:
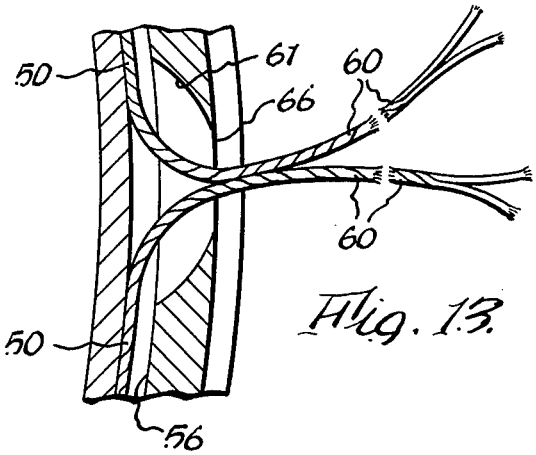

FIG. 10 in a view similar to FIG. 9 but showing how the loop at the end of the flexible wire is pulled out of the lubricant conduit by means of a hook member;

FIG. 11 is a view similar to FIG. 10 but showing the threading of the end of a wick through the loop at the end of the flexible wire;

FIG. 12 is a view similar to FIG. 11 but showing the wick being threaded through the annular lubricant conduit in the ring; and FIG. 13 is a view similar to FIG. 12 but showing the ends of the wick extending outwardly from the ring.

Figure 5:
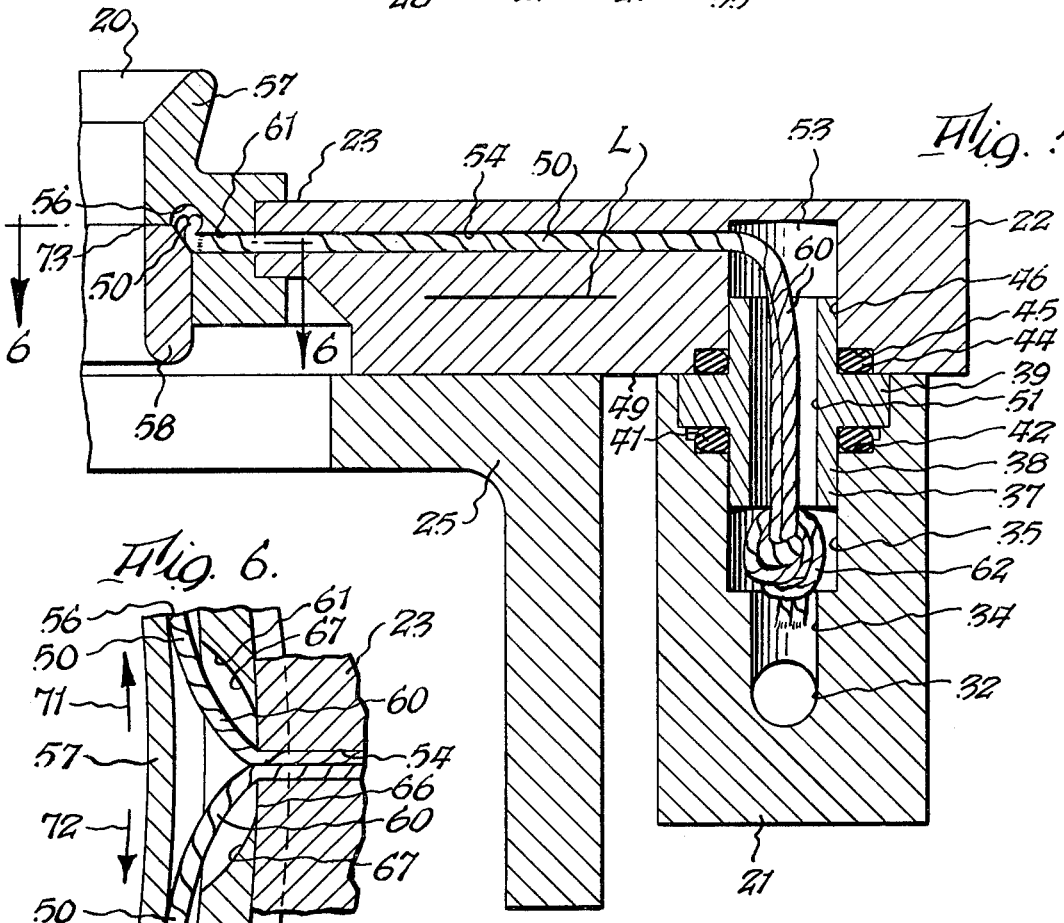
FIG. 5 is a fragmentary cross sectional view taken substantially along line 5—5 of FIG. 3.

The lubrication system which contains the improved spinning and twisting rings of the present invention comprises a gravity feed arrangement wherein a lubricant reservoir 10 feeds an automatic lubricant level tank 11 through conduit 12. Tank 11 may be adjusted to the required elevation on post 13 by means of adjusting screw 14. The purpose of tank 11 is to maintain the lubricant 15 therein at a predetermined level so that there will be a given lubricant head for flow to the remainder of the system. In this respect, the level is maintained so that the lubricant will flow to about level L (FIG. 5) in each of the block-holder assemblies. The lubricant flows from tank 11 into conduit 16 and thence into conduit 18 leading to the remainder of the system. A solenoid valve 17 may be supplied between conduits 16 and 18, and if supplied, solenoid valve 17 is open when the spinning system is in operation to permit lubricant to flow to the various parts of the system. However, when the spinning system is stopped, as by terminating the flow of electric current thereto, solenoid valve 17 automatically closes so as to terminate flow of lubricant to the remainder of the system. Solenoid valve 17 is an extra safeguard, but is not required.

The lubricant is fed to each spinning ring 20 through a lubricant block 21 which is secured to portion 22 of holder 23 by means of a pair of countersunk screws 24. Each holder 23 is attached to a rail 25 by means of screws 26'. As is well known in the art, a plurality of rails 25 (FIG. 1) are mounted on a frame (not shown) of a spinning machine. It will be understood that the lubricant flow is in series through a number of adjacent blocks 21. In this respect, as can be seen from FIG. 2, lubricant conduit 18 leads to the first block 21 and lubricant thereafter flows from block 21 to the next conduit **18*a* which in turn is connected to the next lubricant block 21. A lubricant conduit 18*b* is attached to the other side of the next block 21 and leads to the adjacent block 21, and so on. The tube 18x leading from the last block of a given series is elevated as shown in FIG. 2 at 26 to provide a vent to permit gravity flow of lubricant from tank 11 to each of blocks 21**.

Figure 4:
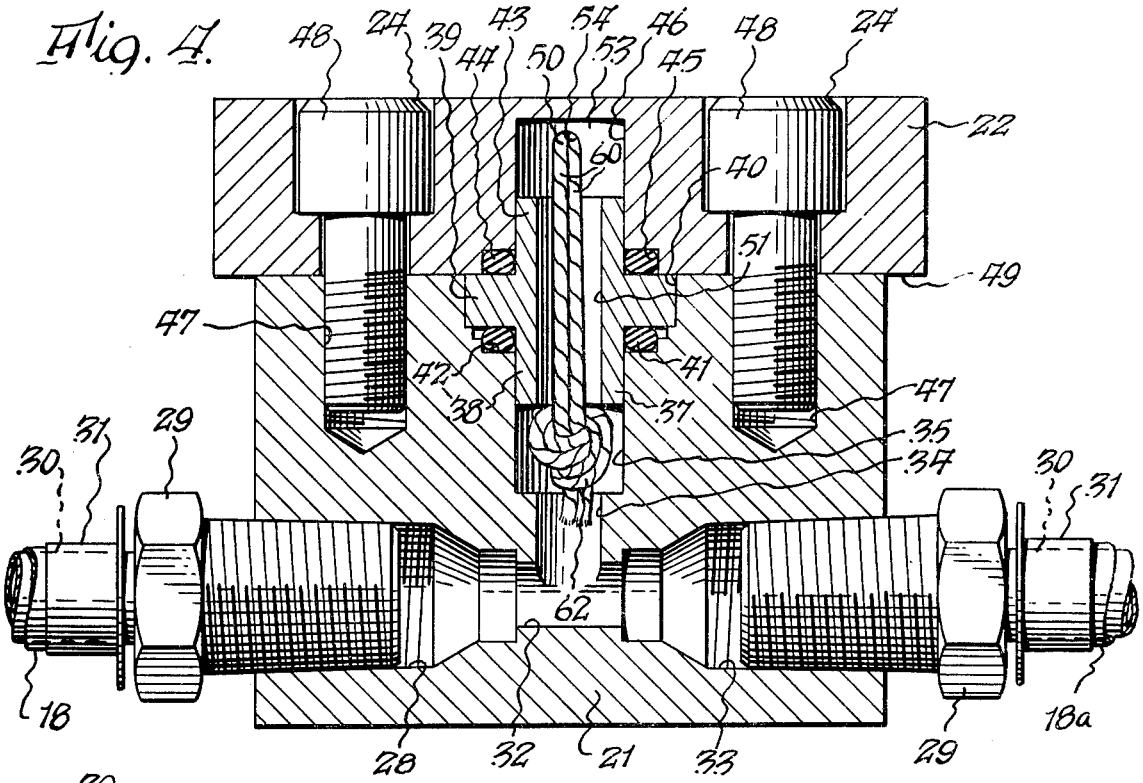
FIG. 4 is a fragmentary enlarged cross sectional view taken substantially along line 4—4 of FIG. 3 and showing the block attached to the holder and showing the end of the wick anchored in the block.

Block 21 is of substantially rectangular solid configuration and includes a tapped aperture 28 (FIG. 4) for receiving fitting 29 is threaded engagement. Fitting 29 includes a nipple portion 30 which receives the end of tube 18, which is of heavy plastic, and a ferrule 31 is slipped over the end of tube 18 to hold it in position on nipple 30. Tapped aperture 28 is in communication with central bore 32 which in turn is in communication with tapped aperture 33 which receives the threaded end of fitting 29 which is identical to fitting 29 received in tapped aperture 28. It is through the foregoing path that lubricant flows through each block 21 from one block to another to lubricate each ring associated with each block.

In order to supply lubricant to each ring 20, a wick 50 is provided. In this respect, a bore 34 is in communication with bore 32. An enlarged bore 35 in block 21 receives end 37 of combined anchoring coupling and seal 38. An annular flange 39 on coupling 38 is received in counterbore 40 in valve body 21. An O-ring 41 encircles end portion 37 at the junction of annular flange 39 and is received in annular groove 42. The opposite end portion 43 of valve metering body 38 is of the same length and diameter as end portion 37 and it also terminates at flange 39. An O-ring 44 encircles portion 43 at its junction with flange 39 and O-ring 44 is received in annular groove 45 which comprises a counterbore in the underside of holder portion 22. Counterbore 45 is in communication with bore 46. As can be seen from FIGS. 4 and 5, end portion 43 is received with a sliding fit in bore 46. When the threaded end portions of screws 24 are received in tapped apertures 47 of block 21 and tightened so that screw heads 48 draw block 21 up into tight engagement with the underside 49 of holder portion 22, O-rings 41 and 44 will be squeezed so as to provide a liquid-tight seal between block 21 and holder portion 22. It is to be especially noted that wick 50 is continuous, thereby obviating the possibility that there will be an unpredictable irregular flow, as may be experienced with wick arrangements which are made up of separate wick portions.

Coupling 38 receives the ends 60 of wick 50 in bore 51. The lubricant which is in chamber 35 and in bore 51 will supply wick 50, which runs through chamber 35, bore 51, chamber 53, bore 54 in holder portion 22, opening 61 in ring 20, and through annular conduit 56. Annular conduit 56 distributes the lubricant to all necessary portions of ring 20. Ring 20 may be of the same construction shown in U.S. Pat. No. 3,831,367, or it may be of any other suitable construction.

The coupling 38 may be turned end for end if desired because the end portions 37 and 43 on opposite sides of flange 39 are of equal length and equal diameter. Therefore, there should be no problem in this respect in assembly. Furthermore, there is a relatively close tolerance between end portions 43 and 37 and bores 46 and 35, respectively, in which they are received with a sliding fit so that these end portions act as an alignment pin between holder 22 and block 21.

In its more specific construction, the wick 50 comprises a strand of "two-ply 8's" wool yarn which extends through annular conduit 56. The end portions 60 of wick 50 converge at enlarged opening portion 61 (FIGS. 5 and 13) of upper ring portion 57 and thereafter pass through conduit 54 in holder portion 22. Thereafter, the ends 60 which pass through bore 51 in fitting 38 are tied into a knot 62 which is larger than the size of bore 51 and thus knot 62 and fitting 38 constitute an anchoring arrangement to insure that the end portion of wick 50 will be submerged in the lubricant in chamber 35 to thereby provide a constant feed of lubricant to annular conduit 56. It will be appreciated that knot 62 is tied after fitting 38 has been inserted in holder portion 22.

The manner in which wick 50 is threaded into ring 20 is shown in FIGS. 9–13. In this respect, an elongated flexible doubled over wire 64 having a loop 65 at the end thereof is inserted through the end 66 of milled opening 61 in ring section 57. It can be seen that milled section 61 has rounded sides 67 which guide loop 65 into conduit 56. The flexible wire 64 is pushed through conduit 56 until the loop portion 65 reaches milled opening 61 (FIG. 10). Thereafter, a hook member 69 is threaded through loop 65 to pull it to the position shown in FIG. 11. An end portion 60 of wick 50 is then threaded through loop 65 and the flexible wire 64 is pulled in the direction of arrow 70 (FIG. 12) to draw wick 50 through annular conduit 56. Thereafter, the end portions 60 are withdrawn through opening 66 as shown in FIG. 13.

After the foregoing threading operation has been completed, a flexible wire is inserted through chamber 53 in holder portion 22 and through conduit 54 and the ends 60 are inserted through a loop in the flexible wire to draw the ends of the wick through conduit 54 and chamber 53. Thereafter, ring 20 may be mounted in position in holder 23. In order to complete the assembly, fitting 38 is inserted into chamber 53 after the ends 60 of wick 50 have been drawn through bore 51 therein, and after knot 62 has been tied, block 21 is mounted in the position and secured by screws 48 to provide the completed assembly shown in FIGS. 4 and 5.

Figure 6:
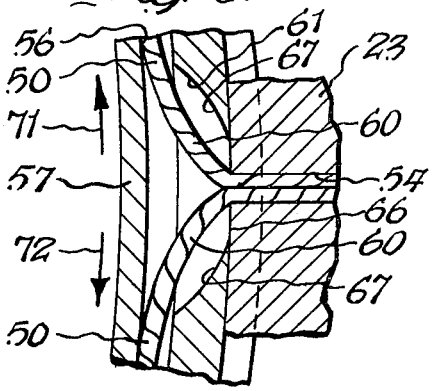
FIG. 6 is a fragmentary cross sectional view taken substantially along line 6—6 of FIG. 5 and showing how the wick passes from the ring conduit into the holder.
Figure 8:
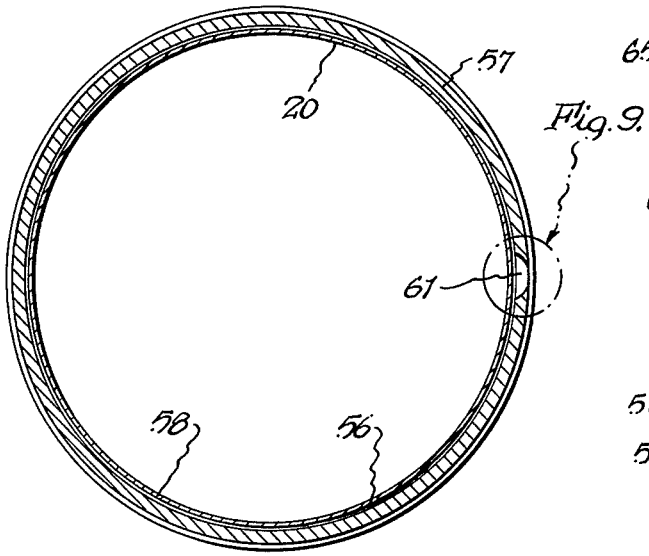
FIG. 8 is a cross sectional view of the entire ring taken substantially along a horizontal plane which includes line 6—6 of FIG. 5 and showing the upper and lower ring sections secured to each other to define a lubricant conduit therebetween.

It can thus be seen that knot 62 in conjunction with bore 51 anchors the ends 60 of wick 50 below the level L of lubricant in holder 22 and block 21. Furthermore, since there are two ends 60, lubricant flow will be through wick 50 in the direction of arrows 71 and 72 (FIG. 6). Thus, a good flow of lubricant will be assured because the flow will be from opposite directions and will not have to flow more than 180° through wick 50 to reach all portions of the ring.

In the particular construction shown, the wick 50 is two-ply 8's wool yarn. Furthermore, the cross sectional area of annular conduit 56 is approximately 0.004 square inches. When wick 50 is twisted tight, its cross sectional area is approximately 40% of the cross section of conduit 56, or approximately 0.0016 square inches. When the wick 50 is free inside of the opening 56, it will expand to occupy approximately the entire opening 56. The lubricant which is supplied has a viscosity of approximately 185–250 Saybolt at 100° F. and an operating minimum viscosity of about 125–145 Saybolt at about 125° F., which is the operating temperature. Furthermore, the seam 73 between ring sections 57 and 58 (FIG. 5) is less than 0.001 inches wide. However, at select portions of the ring there are enlarged slot-like openings between approximately 0.003 – 0.005 inches deep by ½ inches wide and there may be approximately four openings of this size oriented at 90° from each other. A ring of this type is shown in U.S. Pat. No. 3,831,367.

A certain amount of lubricant will flow from annular conduit 56 to lower ring portion 58 at areas 75 (FIGS. 3 and 7). In this respect, a vertical bore 76 is provided in ring portion 58, and this bore is in communication at its upper end with annular conduit 56 and its lower end with cross bore 77 terminating at opposite sides of ring portion 58. A pin 78 of the proper size is located in bore 76 to control the rate of lubricant flow to cross bore 77. Aside from the aforementioned specific openings through which it is intended that lubricant is to flow, the ring sections 57 and 58 are secured to each other with a fluid-tight interference fit to thereby obviate any undesired leakage. In addition, the confining of the wick in the above manner protects it from contamination.

The rings 20 are usually operated in an ambient temperature of between about 80°–90° F. Furthermore, during operation, the friction of the traveler on each ring 20 will raise its temperature to about 125° F. When the ring is heated and possesses the above parameters, good lubricant flow will be provided to the traveler (not shown) so as to cause it to provide good tension to the yarn which is being spun or twisted. However, when the ring cools down to the ambient temperature, that is, after the traveler has ceased movement, the oil will congeal so that there will be practically no oil flow from the ring, thereby obviating appreciable dripping of lubricant therefrom. In other words, an arrangement is provided where wick lubrication is supplied on demand in an automatic manner and when the demand ceases, the flow of lubricant will cease.

It is to be especially noted that the use of a continuous wick in conjunction with a confined groove in the rings provides a desired predictable lubricant flow through predetermined openings without undesirable leakage. Furthermore, because of the parameters which are used, automatic lubricant flow is provided when the ring is in operation and such flow is substantially terminated after operation ceases because of the reduction in temperature of the ring.

While a preferred embodiment of the present invention has been disclosed, it will be appreciated that the present invention is not limited thereto but may be otherwise embodied within the scope of the following claims.

What is claimed is:

1. A spinning and twisting ring construction comprising a ring fabricated from first and second sections secured to each other in fluid-tight relationship by an interference fit, annular conduit means formed entirely within said ring by said first and second sections, first opening means in said ring in communication with said annular conduit means for conducting lubricant to the outside of said ring for providing lubrication for a traveler, second opening means in said ring for conducting lubricant to said annular conduit means from an external source, continuous wick means having a first portion extending substantially throughout said annular groove and a second portion extending outwardly of said ring through said second opening means, said continuous wick means being entirely confined within said annular conduit means except for said second portion, and means communicating with said annular conduit means for permitting threading of said continuous wick means into position in said annular conduit means.

2. A spinning and twisting ring construction as set forth in claim 1 including a holder for mounting said ring, a lubricant block secured to said holder, and means for supplying lubricant to said second portion of said continuous wick means comprising first conduit means in said holder in communication with said second opening means in said ring, second conduit means in said block in communication with said first conduit means, third conduit means in said block for receiving lubricant from an external source, said second portion of said continuous wick means extending through said second opening means in said ring and said first and second conduit means to conduct lubricant from said lubricant block to said first portion of said wick means.

3. A spinning and twisting ring construction as set forth in claim 2 including a coupling member between said holder and said lubricant block, said wick means extending through a bore in said coupling member, and anchoring means on said wick means and located in said block for holding the end of said wick means in said second conduit means.

4. A spinning and twisting ring construction as set forth in claim 3 wherein said anchoring means comprises a knot on said wick means.

5. A spinning and twisting ring construction as set forth in claim 2 including means on said wick means for retaining a portion of said wick means in said second conduit means.

6. A spinning and twisting ring construction as set forth in claim 2 wherein said continuous wick means includes a central portion between two end portions, with said central portion being located in said annular conduit means, and said two end portions extending through said first and second conduit means.

7. A spinning and twisting ring construction as set forth in claim 1 wherein said annular conduit means has a cross sectional area of about 0.004 square inches, and wherein said wick means is of a size of about 2 ply 8's.

8. A spinning and twisting ring construction as set forth in claim 7 wherein said lubricant block contains lubricant having a viscosity of about 185–250 Saybolt at 100° F. and wherein said ring attains an operating termperature of about 125° F. in an ambient temperature of between about 80° to 90° F.

9. A spinning and twisting ring construction as set forth in claim 7 wherein said lubricant block contains lubricant having a viscosity of about 185–250 Saybolt at 100° F. and wherein said ring attains an operating temperature which is at least 30° F. greater than the ambient temperature.

10. A spinning and twisting ring construction as set forth in claim 1 wherein said means communicating with said annular conduit means comprises sides of said second opening means which diverge toward said annular conduit means.

11. A spinning and twisting ring construction as set forth in claim 10 wherein said sides of said second opening means comprise milled rounded sides.

12. A spinning and twisting ring construction comprising a ring fabricated from first and second sections secured to each other in fluid tight relationship by an interference fit, annular conduit means formed entirely within said ring by said first and second sections, first opening means in said ring in communication with said annular conduit means for conducting lubricant to the outside of said ring for providing lubrication for a traveler, second opening means in said ring for conducting lubricant to said annular conduit means from an external source, and wick means having a first portion extending substantially throughout said annular groove and a second portion extending outwardly of said ring through said second opening means, said second opening means including sides which diverge toward said annular conduit means, said wick means being entirely confined within said annular conduit means except for said second portion.

13. A spinning and twisting ring construction as set forth in claim 12 wherein said second opening means comprise a milled opening having rounded sides.

* * * * *